US007066116B2

(12) United States Patent
Jacobsen et al.

(10) Patent No.: US 7,066,116 B2
(45) Date of Patent: Jun. 27, 2006

(54) VALVE SYSTEM FOR A RAPID RESPONSE POWER CONVERSION DEVICE

(75) Inventors: Stephen C. Jacobsen, Salt Lake City, UT (US); Marc Olivier, Sandy, UT (US); Shane Olsen, Centerville, UT (US); Mike Morrison, West Jordan, UT (US)

(73) Assignee: Sarcos Investments LC, Salt Lake City, UT (US)

( * ) Notice: Subject to any disclaimer, the term of this patent is extended or adjusted under 35 U.S.C. 154(b) by 17 days.

(21) Appl. No.: 10/903,759

(22) Filed: Jul. 29, 2004

(65) Prior Publication Data

US 2006/0021589 A1 Feb. 2, 2006

(51) Int. Cl.
*F02M 23/00* (2006.01)

(52) U.S. Cl. ..... 123/46 R

(58) Field of Classification Search ..... 123/46 R, 123/46 E, 46 B, 46 A, 46 SC; 417/364, 417/396, 416

See application file for complete search history.

(56) References Cited

U.S. PATENT DOCUMENTS

| | | | |
|---|---|---|---|
| 179,782 A | 7/1876 | Gilles | |
| 3,170,406 A | 2/1965 | Robertson | |
| 3,234,395 A | 2/1966 | Colgate | |
| 3,868,931 A | 3/1975 | Dutry et al. | |
| 4,167,922 A | 9/1979 | Doundoulakis | |
| 5,109,810 A | 5/1992 | Christenson | |
| 5,685,215 A | 11/1997 | Jepsen et al. | |
| 5,894,730 A | 4/1999 | Mitchell | |
| 6,029,616 A * | 2/2000 | Mayne et al. | 123/46 R |
| 6,241,488 B1 | 6/2001 | Luoto | |
| 6,244,226 B1 | 6/2001 | Berlinger et al. | |
| 6,626,650 B1 | 9/2003 | Kenchington et al. | |

* cited by examiner

*Primary Examiner*—Henry C. Yuen
*Assistant Examiner*—Hyder Ali
(74) *Attorney, Agent, or Firm*—Thorpe North & Western LLP

(57) ABSTRACT

An apparatus and method for transferring energy from an internal combustion engine to drive a load. The system includes a rapid response component, a valve system and an actuator. The rapid response component is configured to be operatively coupled to a combustion portion of the internal combustion engine. The rapid response component is also configured to draw a portion of energy from the combustion in the internal combustion engine and transfer the portion of energy as a fluid including pulsitile fluid flow. The valve system is operatively coupled to the rapid response component and is operable to receive and controllably direct the pulsitile fluid flow from the rapid response component. The actuator is operatively coupled to the valve system and is configured to be operatively coupled to the load. The actuator operates to receive the fluid from the valve system to drive the load operatively coupled thereto.

32 Claims, 9 Drawing Sheets

VALVE SYSTEM FOR A RAPID RESPONSE POWER CONVERSION DEVICE

SPECIFICATION

Priority of application No. 60/303,053 filed Jul. 5, 2001, and application Ser. No. 10/190,336 filed Jul. 5, 2002 in the United States Patent Office is hereby claimed.

BACKGROUND OF THE INVENTION

1. Field of the Invention

The present invention relates generally to valve systems. More specifically, the present invention relates to an apparatus and method of transferring energy through a valve system from combustion in an internal combustion engine.

2. Related Art

Primary power sources that directly convert fuel into usable energy have been used for many years in a variety of applications including motor vehicles, electric generators, hydraulic pumps, etc. Perhaps the best known example of a primary power source is the internal combustion engine, which converts fossil fuel into rotational power. Internal combustion engines are used by almost all motorized vehicles and many other energetically autonomous devices such as lawn mowers, chain saws, and emergency electric generators. Converting fossil fuels into usable energy is also accomplished in large electricity plants, which supply electric power to power grids accessed by thousands of individual users. While primary power sources have been successfully used to perform these functions, they have not been successfully used independently in many applications because of their relatively slow response characteristics. This limitation is particularly problematic in powering robotic devices and similar systems which utilize a feedback loop which makes real time adjustments in movements of the mechanical structure. Typically, the power source in such a system must be able to generate power output which quickly applies corrective signals to power output as necessary to maintain proper operation of the mechanical device.

The response speed of a power source within a mechanical system, sometimes referred to as bandwidth, is an indication of how quickly the energy produced by the source can be accessed by an application. An example of a rapid response power system is a hydraulic power system. In a hydraulic system, energy from any number of sources can be used to pressurize hydraulic fluid and store the pressurized fluid in an accumulator. The energy contained in the pressurized fluid can be accessed almost instantaneously by opening a valve in the system and releasing the fluid to perform some kind of work, such as extending or retracting a hydraulic actuator. The response time of this type of hydraulic system is very rapid, on the order of a few milliseconds or less.

An example of a relatively slow response power supply system is an internal combustion engine. The accelerator on a vehicle equipped with an internal combustion engine controls the rotational speed of the engine, measured in rotations per minute ("rpms"). When power is desired the accelerator is activated and the engine increases its rotational speed accordingly. But the engine cannot reach the desired change in a very rapid fashion due to inertial forces internal to the engine and the nature of the combustion process. If the maximum rotational output of an engine is 7000 rpms, then the time it takes for the engine to go from 0 to 7000 rpms is a measure of the response time of the engine, which can be a few seconds or more. Moreover, if it is attempted to operate the engine repeatedly in a rapid cycle from 0 to 7000 rpms and back to 0 rpms, the response time of the engine slows even further as the engine attempts to respond to the cyclic signal. In contrast, a hydraulic cylinder can be actuated in a matter of milliseconds or less, and can be operated in a rapid cycle without compromising its fast response time.

For this reason, many applications utilizing slow response mechanisms require the energy produced by a primary power source be stored in another, more rapid response energy system which holds energy in reserve so that the energy can be accessed instantaneously. One example of such an application is heavy earth moving equipment, such as backhoes and front end loaders, which utilize the hydraulic pressure system discussed above. Heavy equipment is generally powered by an internal combustion engine, usually a diesel engine, which supplies ample power for the operation of the equipment, but is incapable of meeting the energy response requirements of the various components. By storing and amplifying the power from the internal combustion engine in the hydraulic system, the heavy equipment is capable of producing great force with very accurate control. However, this versatility comes at a cost. In order for a system to be energetically autonomous and be capable of precise control, more components must be added to the system, increasing weight and cost of operation of the system.

Another example of a rapid response power supply is an electrical supply grid or electric storage device such as a battery. The power available in the power supply grid or battery can be accessed as quickly as a switch can be opened or closed. A myriad of motors and other applications have been developed to utilize such electric power sources. Stationary applications that can be connected to the power grid can utilize direct electrical input from the generating source. However, in order to use electric power in a system without tethering the system to the power grid, the system must be configured to use energy storage devices such as batteries, which can be very large and heavy. As modem technology moves into miniaturization of devices, the extra weight and volume of the power source and its attendant conversion hardware are becoming major hurdles against meaningful progress.

The complications inherent in using a primary power source to power a rapid response source become increasingly problematic in applications such as robotics. Further, transferring and controlling the energy from the rapid response source to a useable system is problematic as well. In order for a robot to accurately mimic human movements, the robot must be capable of making precise, controlled, and timely movements. This level of control requires a rapid response system such as the hydraulic or electric systems discussed above. Because these rapid response systems require power from some primary power source, the robot must either be part of a larger system that supplies power to the rapid response system or the robot must be directly fitted with heavy primary power sources or electric storage devices. Ideally, however, robots and other applications should have minimal weight, and should be energetically autonomous, not tethered to a power source with hydraulic or electric supply lines. To date, however, technology has struggled to realize this combination of rapid response, minimal weight, effective control, and autonomy of operation.

SUMMARY OF THE INVENTION

The present invention relates to an apparatus and method for providing a system configured to transfer energy from an internal combustion engine. The internal combustion engine includes a chamber and a piston with a combustion portion in the chamber, the chamber having at least one fuel inlet to supply fuel thereto and an exhaust outlet. The fuel is operable to at least partially facilitate combustion in the combustion portion of the chamber to provide energy therein and to act upon the piston.

The system includes a rapid response component, a valve system and an actuator. The rapid response component is configured to be operatively coupled to the combustion portion of the chamber. The rapid response component also is configured to draw a portion of the energy from the combustion in the chamber and transfer the portion of the energy as a fluid including pulsitile fluid flow. The valve system is operatively coupled to the rapid response component and is operable to receive the pulsitile fluid flow from the rapid response component and controllably direct said pulsitile fluid flow from the rapid response component. The actuator is operatively coupled to the valve system and is configured to be coupled to the load. The actuator is operable to receive the fluid from the valve system to drive the load coupled thereto.

In one embodiment, the present invention provides a method and apparatus for providing a valve/actuator system configured to control pulsitile fluid flow from a rapid response component associated with an internal combustion engine. The valve/actuator system includes a gate valve, a proportional valve, a directional valve and an actuator. The gate valve is configured to be operatively coupled to the rapid response component and includes opened and closed configurations to match the pulsitile fluid flow from the rapid response component. The proportional valve is operatively coupled to the gate valve and is operable to selectively restrict the pulsitile fluid flow from the gate valve to provide a selectively restricted fluid flow from the proportional valve. The directional valve is operatively coupled to the proportional valve and is operable to receive the selectively restricted fluid flow from the proportional valve and selectively direct a selectively directed fluid flow. The actuator is operatively coupled to the directional valve and is operable to receive the selectively directed fluid flow from the directional valve to drive a load coupled to said actuator.

Other features and advantages of the present invention will become apparent to those of ordinary skill in the art through consideration of the ensuing description, the accompanying drawings, and the appended claims.

BRIEF DESCRIPTION OF THE DRAWINGS

While the specification concludes with claims particularly pointing out and distinctly claiming that which is regarded as the present invention, the advantages of this invention may be ascertained from the following description of the invention when read in conjunction with the accompanying drawings, in which:

DETAILED DESCRIPTION

Figure 1:
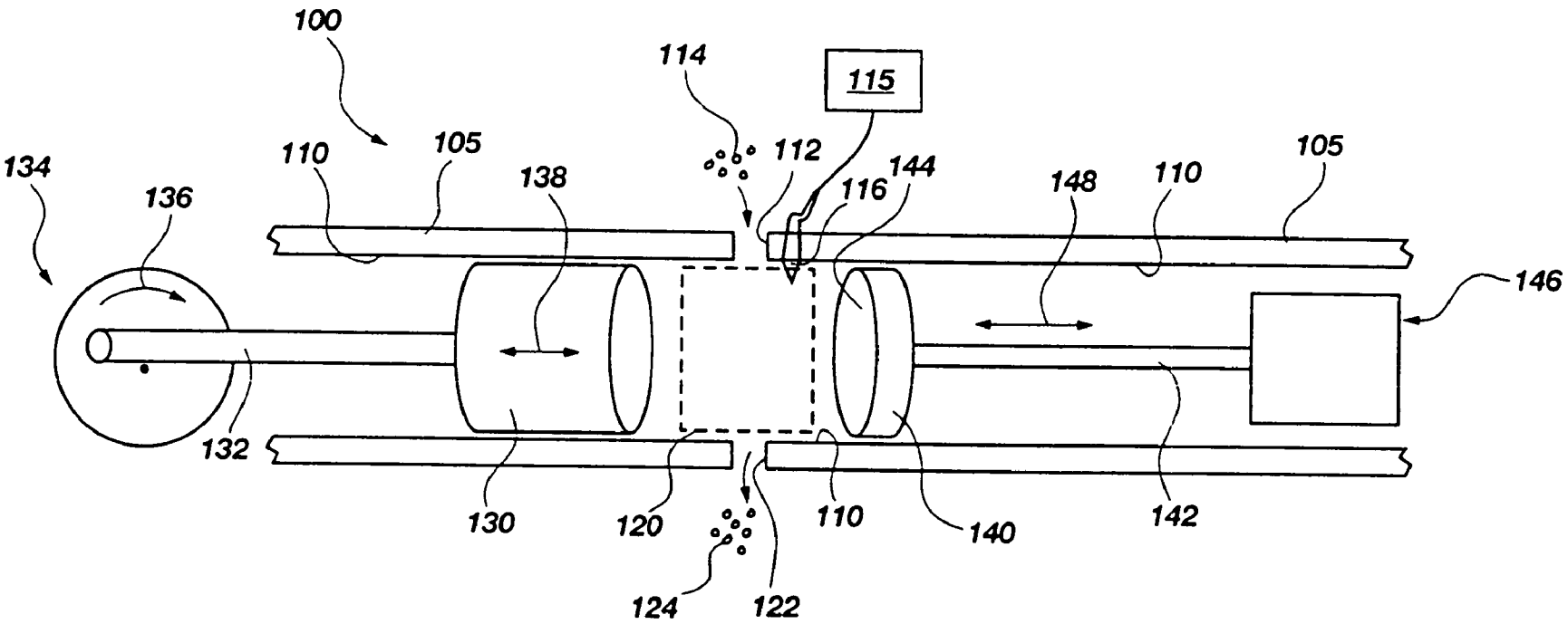
FIG. 1 illustrates is a schematic side view of a rapid response energy extracting system, depicting a chamber having a primary piston and a secondary piston, according to a first embodiment of the present invention.

For the purposes of promoting an understanding of the principles of the present invention, reference will now be made to the exemplary embodiments illustrated in the drawings, and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Referring first to FIG. 1, a simplified schematic view of a rapid response energy extracting system 100 is illustrated. Such a system 100 may partially include a typical internal combustion ("IC") engine, such as a four stroke spark ignition IC engine. Other types of engines may also be utilized with the present invention, such as compression ignition IC engines, two stroke IC engines, non-combustion engines or any other suitable engine. For purposes of simplicity, rapid response energy extracting system 100 is illustrated here in conjunction with a typical four stroke spark ignition IC engine, wherein a single chamber 110 is depicted with the present invention.

The chamber 110 is defined by chamber walls 105 and includes one or more intake ports 112 for receiving a fuel 114 and an oxidizer such as air or oxygen, separately or as a mixture, and an out-take port 122 for releasing combustive exhaust gasses 124. Each of the intake port 112 and the out-take port 122 includes a valve (not shown), which are each configured to open and close at specified times to allow fuel 114 and exhaust 124 to enter and exit the chamber 110, respectively. The chamber 110 includes a primary piston 130, a secondary piston 140 and a combustion portion 120 therebetween. The primary piston 130 is interconnected to a piston rod 132, which in turn is interconnected to a crank shaft 134. The primary piston 130 is sized and configured to move linearly within the chamber 110 for converting linear movement 138 from the primary piston 130 to the crank shaft 134 into rotational energy 136. Such rotational energy 136 may be used to power a wide range of external applications, such as any type of application that typically utilizes an IC combustion engine.

The linear movement 138 of the primary piston 130 takes place between a top dead center ("TDC") position and a bottom dead center ("BDC") position. The TDC position occurs when the piston 130 has moved to its location furthest from the crank shaft 134 and the BDC position occurs when the primary piston 130 has moved to its location closest to the crank shaft 134. The linear movement of the primary piston 130 between the TDC position and the BDC position may be generated by cyclic combustion in the combustion portion 120 of the chamber 110. Primary piston 130 may also move linearly within chamber 110 by other suitable means, such as an electric motor using energy from a battery.

A four stroke cycle of an IC engine begins with the piston 130 located at TDC. As the piston 130 moves toward BDC, a fuel 114 and oxidizer or combustible mixture is introduced into the chamber 110 through intake port 112, which may include one or more openings and may also be a variable opening for varying the flow and amount of fuel 114 into the chamber 110. Once the fuel 114 enters the chamber 110, the intake port 112 is closed and the piston 130 returns toward TDC, compressing the combustible mixture and/or fuel 114 in the chamber 110. An ignition source 116, controlled by a controller 115, supplies a spark at which point the compressed fuel combusts and drives the piston 130 back to BDC. The controller 115 may also be configured to control the valves (pot shown) at the intake port 112 and the out-take port 122 to control the rate by which fuel 114 may feed the chamber 110. As the piston 130 returns again toward TDC, combustive exhaust gases 124 are forced through out-take port 122. The out-take port 122 is then closed, and intake port 112 is opened, and the four stroke cycle may begin again. In this manner, a series of combustion cycles powers the crank shaft 134, which provides rotational energy 136 to an external application.

According to the present invention, chamber 110 also includes a secondary piston 140 having a secondary piston rod 142 extending therefrom. The secondary piston 140 includes a face, or energy receiving end 144, and the secondary piston rod 142 is coupled to an energy transferring portion 146. The energy receiving end 144 may be positioned in chamber 110 to face primary piston 130 so that the longitudinal movement of the primary piston 130 and the secondary piston 140 corresponds with a longitudinal axis of chamber 110. In an inactive position, the energy receiving end 144 of the secondary piston 140 may be biased in a substantially sealing, retracted position against a lip or some other suitable sealing means, biased by a spring or by another suitable biasing force, such as a pressure reservoir, so that the secondary piston 140 is biasingly positioned prior to introducing fuel into the combustion chamber 110 or prior to combustion during cyclic combustion of the system 100.

One important aspect of the present invention is that the secondary piston 140 includes a substantially lower inertia than that of the primary piston 130. Such a substantially lower inertia positioned adjacent the combustion portion 120 of the chamber 110 facilitates a rapid response to combustion, which provides linear movement 148 of the secondary piston 140 along the longitudinal axis of the chamber 110. Because the inertia of the secondary piston 140 is much lower than the inertia of the primary piston 130, the secondary piston 140 can efficiently extract a large fraction of the energy created by the combustion before it is otherwise lost to inefficiencies inherent in IC engines. With this arrangement, the energy receiving end 144 of the secondary piston 140 is sized, positioned and configured to react to combustion in the chamber 110 so as to provide linear movement 148 to the energy receiving end 144 to then act upon the energy transferring portion 146 of the system 100.

Figure 2:
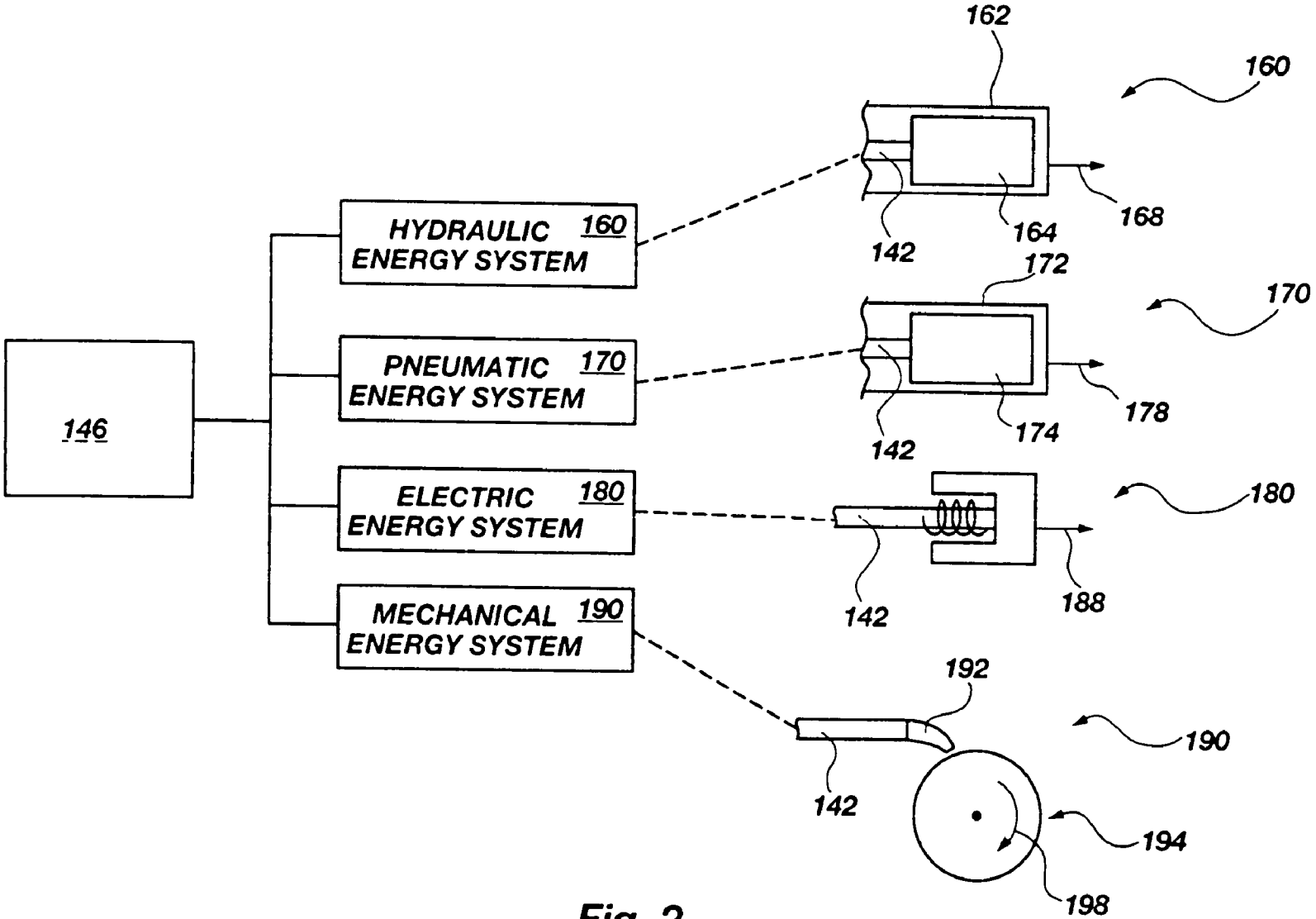
FIG. 2 illustrates a block diagram associated with various partial schematic side views, depicting various forms of energy transfer through an energy transfer portion of the rapid response energy extracting system, according to the first embodiment of the present invention.

Referring now to FIG. 2, the energy transferring portion 146 may include and/or may be coupled with any number of energy conversion devices. In particular, the energy transferring portion 146 is configured to transfer the linear movement of the secondary piston 140 to any one of hydraulic energy, pneumatic energy, electric energy and/or mechanical energy. Transferring linear motion into such various types of energy is well known in the art.

For example, in a hydraulic system 160, linear motion via the secondary piston rod 142 transferred to a hydraulic piston 164 in a hydraulic chamber 162 may provide hydraulic pressure and flow 168, as well known in the art. Similarly, in a pneumatic system 170, the secondary piston rod 142 may provide linear motion to a pneumatic piston 174 in a pneumatic chamber 172 to provide output energy in the form of pneumatic pressure and gas flow 178.

Other systems may include an electrical system 180 and a mechanical system 190. As well known in the art, in an electrical system 180, the linear motion of secondary piston rod 142 may be interconnected to an armature with a coil wrapped therearound, wherein the armature reciprocates in the coil to generate an electrical energy output 188. Furthermore, in the mechanical system, linear motion from secondary piston rod 142 may be transferred to rotational energy 198 with a pawl 192 pushing on a crank shaft 194 to provide rotational energy 198. Additionally, the secondary piston rod 142 may be directly interconnected to the crank shaft 194 to provide the rotational energy 198. Other methods of converting energy will be apparent to those skilled in the art. For example, rotational electric generators, gear driven systems, and belt driven systems can be utilized by the energy transferring portion 146 the present invention.

Figure 3:
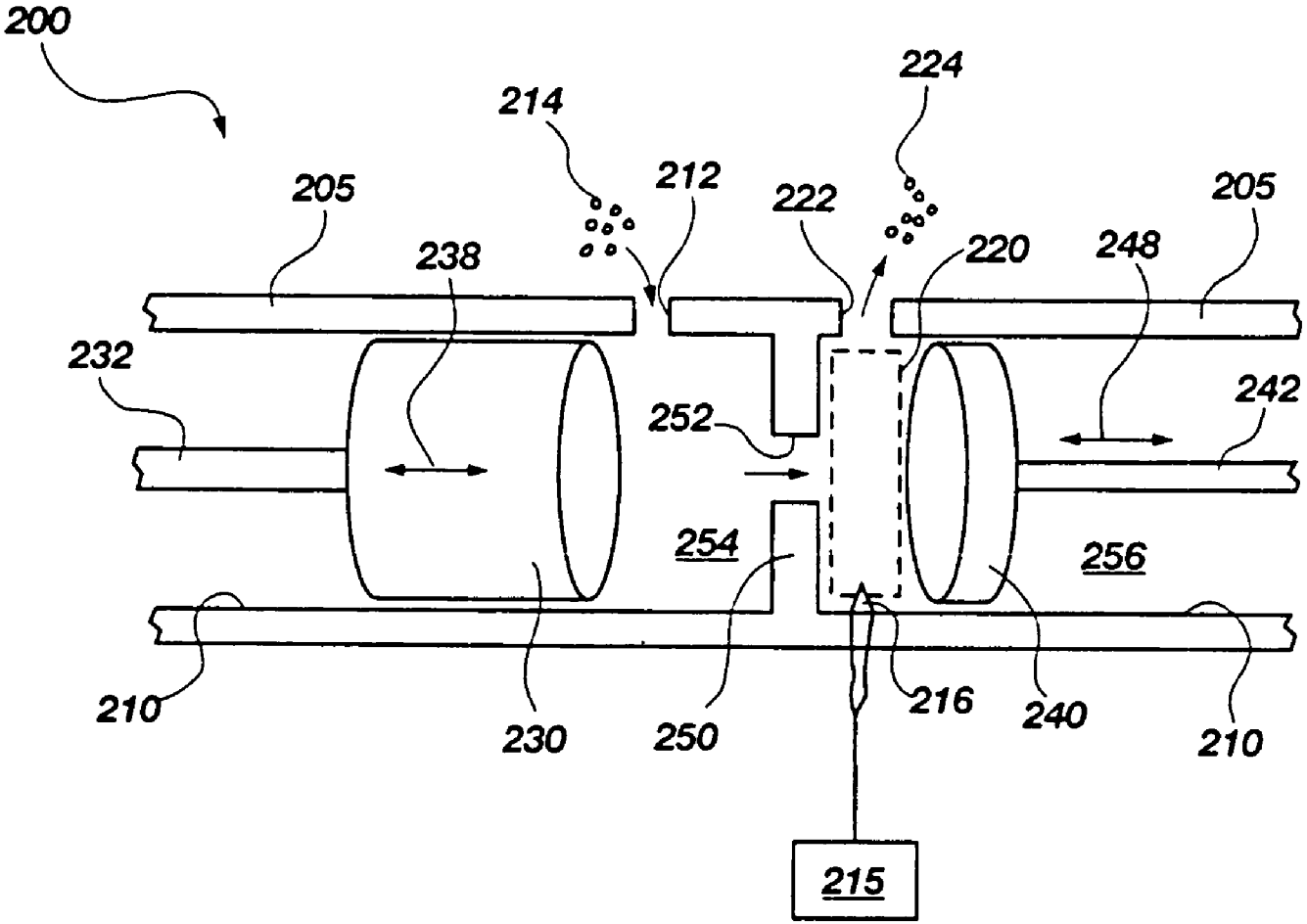
FIG. 3 illustrates a partial schematic side view of the rapid response energy extracting system, depicting a chamber having multiple compartments, according to a second embodiment of the present invention.

Referring now to FIG. 3, there is illustrated a second embodiment of the rapid response energy extracting system 200. The second embodiment is similar to the first embodiment, except the chamber 210 defines a first compartment 254 and a second compartment 256 with a divider portion 250 disposed therebetween. The divider portion 250 defines an aperture 252 therein, which aperture 252 extends between the first compartment 254 and the second compartment 256. With this arrangement, the primary piston 230 is positioned in the first compartment 254 and the secondary piston 240 is positioned in the second compartment 256. The intake port 212 allows fuel 214 and/or combustible mixture to enter the first compartment 254. The fuel 214 and/or combustible mixture are pushed through the aperture 252 from the first compartment 254 into the second compartment 256 via the primary piston 230. The fuel 214 and/or combustible mixture is compressed at a combustion portion 220 of the chamber 210, which is directly adjacent the secondary piston 240. An ignition source 216 then fires the fuel for combustion, wherein the secondary piston 240 moves linearly, as indicated by arrow 248, with a rapid response to the combustion. The combustive exhaust 224 then exits through the out-take port 222. It should be noted that the first compartment 254 and second compartment 256 may be remote from each other, wherein the first and second compartments 254 and 256 may be in fluid communication with each other via a tube.

In the second embodiment, the primary piston 230 may reciprocate via combustion or an electric power source to push the fuel 214 from the first compartment to the second compartment of chamber 210. By having a divider portion 250, the combustion at the combustion portion 220 of the chamber 210 can be at least partially, or even totally, isolated from the primary piston 230. Depending on the requirements of the system 200, the controller 215 may be configured to open or close aperture 252 at varying degrees to isolate combustion from the primary piston 230. As such, in the instance of total isolation, a maximum amount of energy to the secondary piston 240 may be transferred by a rapid response to combustion. It is also contemplated that the primary piston 230 in the first compartment 254 may include a positive displacement compressor and/or an aerodynamic compressor, such as a centrifugal compressor.

Figure 4:
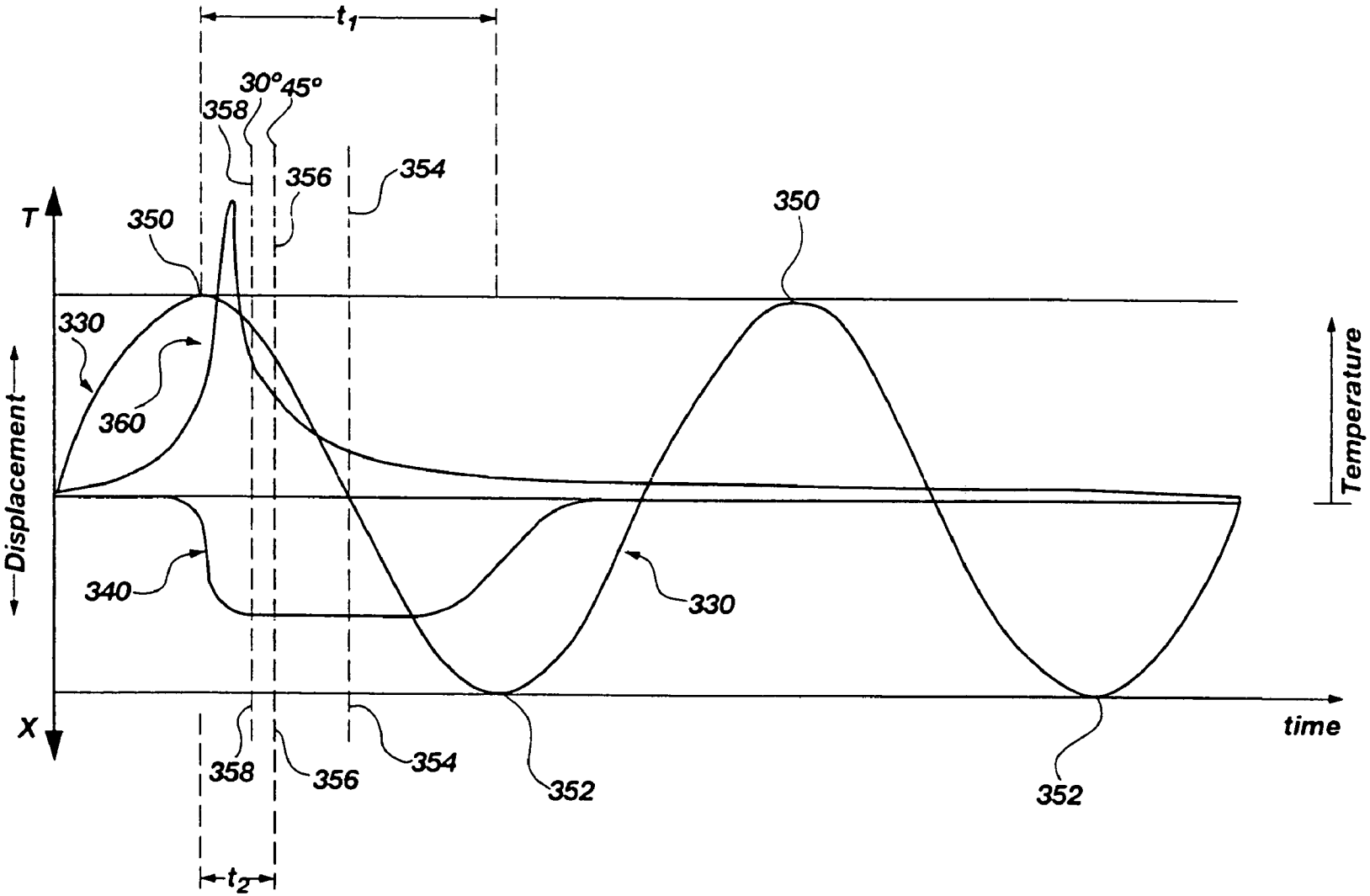
FIG. 4 illustrates a graphical representation of physical response characteristics of the primary piston with respect to the secondary piston in terms of time, temperature and displacement of the primary and secondary pistons, according to the present invention.

Referring now to FIGS. 1 and 4, a graphical diagram of the physical response characteristics of the secondary piston 140 with respect to the primary piston 130 is illustrated. Line 330 represents the linear movement 138 of the primary piston 130, reciprocating between the TDC 350 and the BDC 352 positions thereof. Line 330 illustrates one complete cycle, for a four cycle IC engine, in which the primary piston 130 travels between the TDC 350 and the BDC 352 positions twice, with one combustion event occurring immediately after the primary piston 130 reaches TDC the first time. Line 340 illustrates the linear displacement of the secondary piston 140. As indicated, the secondary piston 140 reaches substantially full displacement within at least 45 degrees, and even up to 30 degrees, of the primary piston 140 descending from TDC 350, wherein the secondary piston 140 completes one cycle much more rapidly than does the primary piston 130.

Turning now to line 360, a relative indication of the temperature rise and fall in the chamber 110 due to combustion and heat loss, respectively, with respect to the linear positions of the primary piston 130 and the secondary piston 140 is shown. Immediately after ignition of the fuel 114 and/or combustible mixture, when the primary piston 130 is proximate the TDC 350 position, combustion facilitates a dramatic increase in temperature. As well known, IC engines are designed to convert the thermal energy created by combustion into linear movement of the primary piston, which is in turn converted into rotational energy in the drive shaft. However, much of the thermal energy created in conventional internal combustion engines is lost due to heat escaping into the engine walls surrounding the combustion chamber and in exhaust gases. Even the most efficient internal combustion engines rarely reach efficiency rates of more than 35%. Consequently, more than half of the energy available from the combusted fuel is lost in the form of heat through the walls and piston via conduction and radiation, as well as heat released through the exhaust.

The heat rise and heat loss illustrated by the rising and dropping line 360, representing combustion, depicts the time during which energy is available in the form of thermal energy and the time in which the primary piston 130 should be extracting the thermal energy. Time $t_2$ indicates the time period during which a majority of the thermal energy is available for conversion by the primary piston. Time $t_1$ indicates the time period during which the primary piston 130 is moving from the TDC 350 to BDC 352 positions. It is during the period $t_1$ that the primary piston 130 should be converting energy from the combustion process. As indicated by the difference between the two time periods $t_1$ and $t_2$, most of the thermal energy from the combustion escapes prior to the primary piston 130 reaching a median 354 of its travel between the TDC 350 to BDC 352 positions.

However, according to the present invention, the secondary piston 140 substantially completes its useful energy extraction cycle before the expiration of time period $t_2$. In particular, as indicated by line 340, at least 90% of the energy extracted by the secondary piston 140 is extracted within at least 45 degrees, and even at least 30 degrees, of the primary piston 140 descending from the TDC 350 position. Because the secondary piston 140 moves much more rapidly than does the primary piston 130, it can convert a much greater percentage of the thermal energy into linear motion before the thermal energy is lost to the heat sink formed by the walls, primary piston, and other components of the IC engine. Additionally, because the secondary piston 140 acts independently of the primary piston 130 and because the secondary piston 140 has a substantially lower inertia than the primary piston 130, the secondary piston 140 reacts to combustion with a very short response time without being inhibited by the primary piston 130.

For example, an IC engine having operating characteristics running at 3000 revolutions per minute, $t_1$ would be approximately 10 milliseconds, or 0.010 seconds, and $t_2$ would be approximately 3 milliseconds. Because the secondary piston 140 can be operated independently of the primary piston 130, the secondary piston 140 can be operated with a response time of approximately 3 milliseconds or potentially even at a shorter response time. In other words, the secondary piston 140 can both begin and stop extracting energy from the combustion cycles of the system 100 within at least a 3 millisecond time period. Higher cycle rate can be achieved by operating the primary piston 130 at a higher speed (i.e., higher number of rpms).

Figure 5:
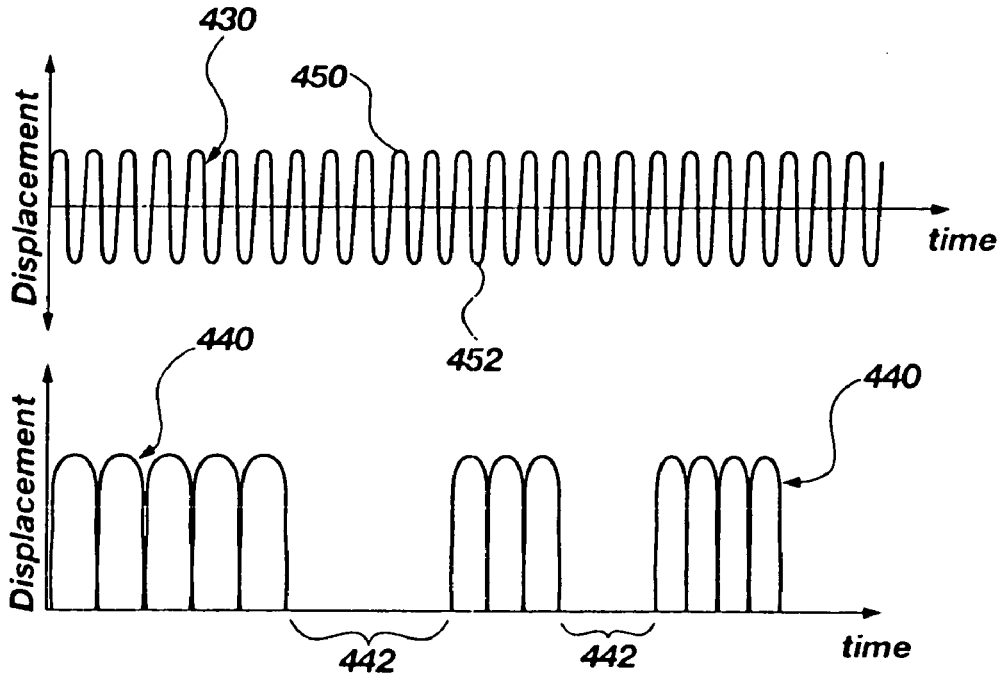
FIG. 5 illustrates a graphical representation of the physical response characteristics of the primary piston with respect to the secondary piston, depicting impulse modulation of the secondary piston, according to the present invention.

Turning to FIGS. 1 and 5, physical response characteristics, such as impulse modulation and superior bandwidth provided by the secondary piston 140 with respect to the primary piston 130, is illustrated. In particular, line 430 depicts the primary piston 130 reciprocating repeatedly or substantially continuously with a substantially fixed displacement between the TDC and BDC positions. As the primary piston 130 continuously reciprocates, the controller 115 is configured to control combustion at selective cycles of reciprocation of the primary piston 130. The reciprocation cycles of the primary piston 130 in which combustion is selected are illustrated in corresponding lines 440. Line 440 indicates a portion of energy extracted by the secondary piston 140 from the selected cycles of the primary piston 130 where the controller 115 controls or initiates combustion (i.e., amplitude modulation, impulse modulation, and frequency modulation). The flat portion 442 of line 440 corresponds to the absence of combustion, showing no displacement and energy extraction from the secondary piston 140.

As shown, the primary piston 130 continuously reciprocates in the chamber 110, wherein the controller 115 selectively controls particular reciprocating cycles in which combustion occurs. As such, the cycles selected for combustion to facilitate the extraction of a portion of the combustion energy may include each reciprocation cycle of the primary piston or, as indicated, an impulse modulation. Such an impulse modulation provides thermal energy extracted over one or more selected cycles of the primary piston 130 as well as one or more sequence of selected cycles where no energy is extracted.

Figure 6:
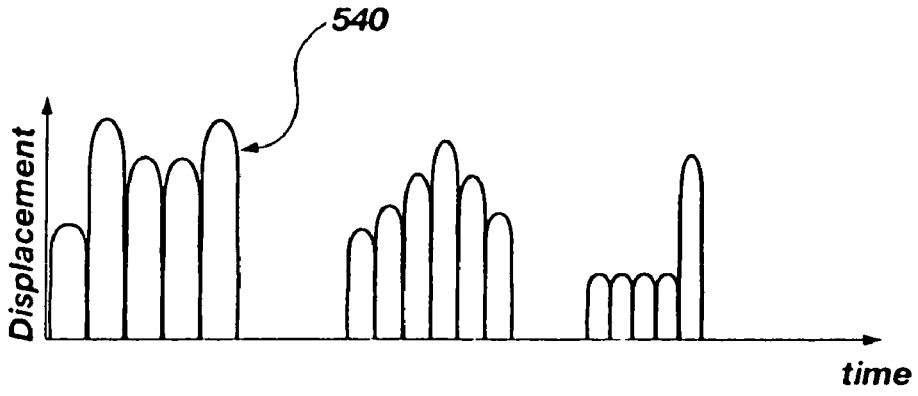
FIG. 6 illustrates a graphical representation of the physical response characteristics of the secondary piston, depicting a combination of impulse and amplitude modulation of the secondary piston, according to the present invention.

As can be readily recognized by one of ordinary skill in the art, the impulse modulation illustrates that the rate by which energy may be extracted and then stopped from extracting energy is extremely rapid. Such ability to extract energy and then rapidly stop extracting, and then again rapidly extract energy at selected cycles of the primary piston 130 provides a favorable bandwidth far superior to the bandwidth of the energy extraction and conversion of the primary piston 130. Thus, energy may be provided and stopped with a rapid response and with favorable bandwidth by the controller 115 controlling the combustion at selected cycles and the secondary piston 140 reacting to the combustion, as indicated by line 440. Furthermore, referencing FIGS. 1 and 6, the controller 115 may control the fuel 114 and combustion at selected cycles of the primary piston 130 so that the secondary piston 140 extracts a portion of the combustion energy to provide amplitude modulation and, further, impulse amplitude modulation 540. Further, a person of ordinary skill in the art will readily recognize that the controller 115 may control the fuel 114 and combustion at selected cycles so as to provide frequency modulation and even frequency, impulse modulation, or, even frequency, amplitude modulation.

Figure 7:
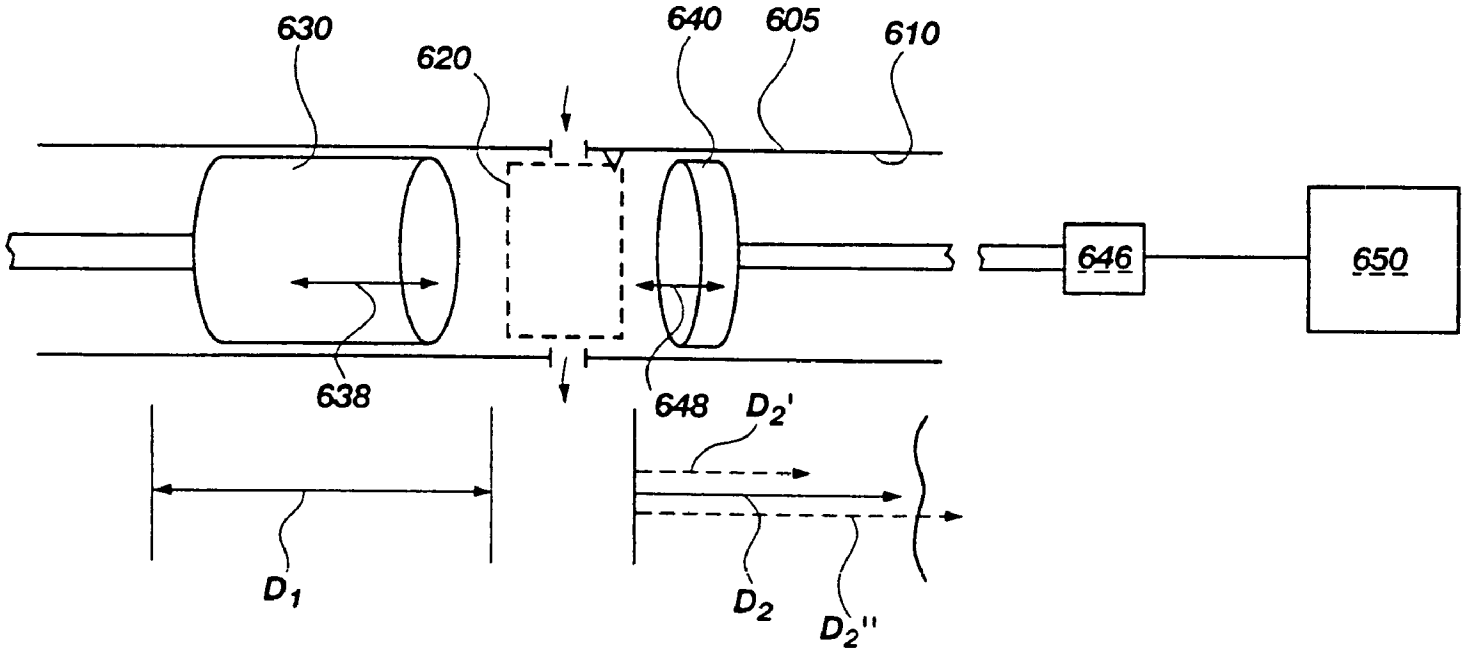
FIG. 7 illustrates a partial schematic side view of the rapid response energy extracting system, depicting the primary and secondary pistons in terms of linear displacement, according to the present invention.
Figure 7A:
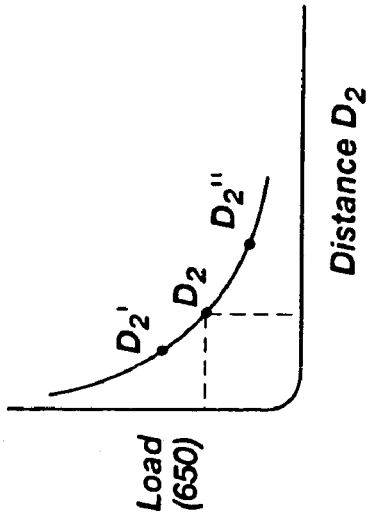
FIG. 7A illustrates a graphical representation of the linear displacement of the secondary piston with respect to heavier and lighter loads, according to the present invention.

Turning to FIG. 7, there is illustrated relative linear movement with respect to the primary piston 630 and the secondary piston each in chamber 610. In particular, the linear movement 638 of the primary piston 630 in chamber 610 is substantially constant with a displacement D1. On the other hand, the linear movement 648 of the secondary piston may be variable in length referenced as displacement D2. Such variable length of displacement D2 of the secondary piston may change with respect to a load 650 of which the energy extracted by the secondary piston is acting upon. Other factors that effect the displacement D2 of the secondary piston 640 relate to inertia of the mass of secondary piston 640 and its piston rod 642. As previously set forth, the effective inertia of the primary piston 630, an crank assembly is greater than the effective inertia of the secondary piston 640 by a ratio of at least 5:1, and even at least 10:1, at least during the time period when a portion of energy is extracted from combustion by the secondary piston 640. Since the inertia of the secondary piston 640 is less than the inertia of the primary piston 630, the secondary piston 640 is able to react with a rapid response. In this manner, the displacement D2 of the secondary piston 640 is variable in length, in which the displacement D2 naturally matches and corresponds with at least the load 650 to which the extracted energy is acting upon as well as with respect to the combustion force acting on the secondary piston 640 at combustion. D2' and D2" represent a variety of lengths which form a continuum of values, corresponding to a continuous transmission system. This is illustrated in FIG. 7A, wherein D2' corresponds to a heavier load, and D2" relates to a lighter load, thereby eliminating the need for a separate transmission device as is typically required for an IC engine.

Figure 8:
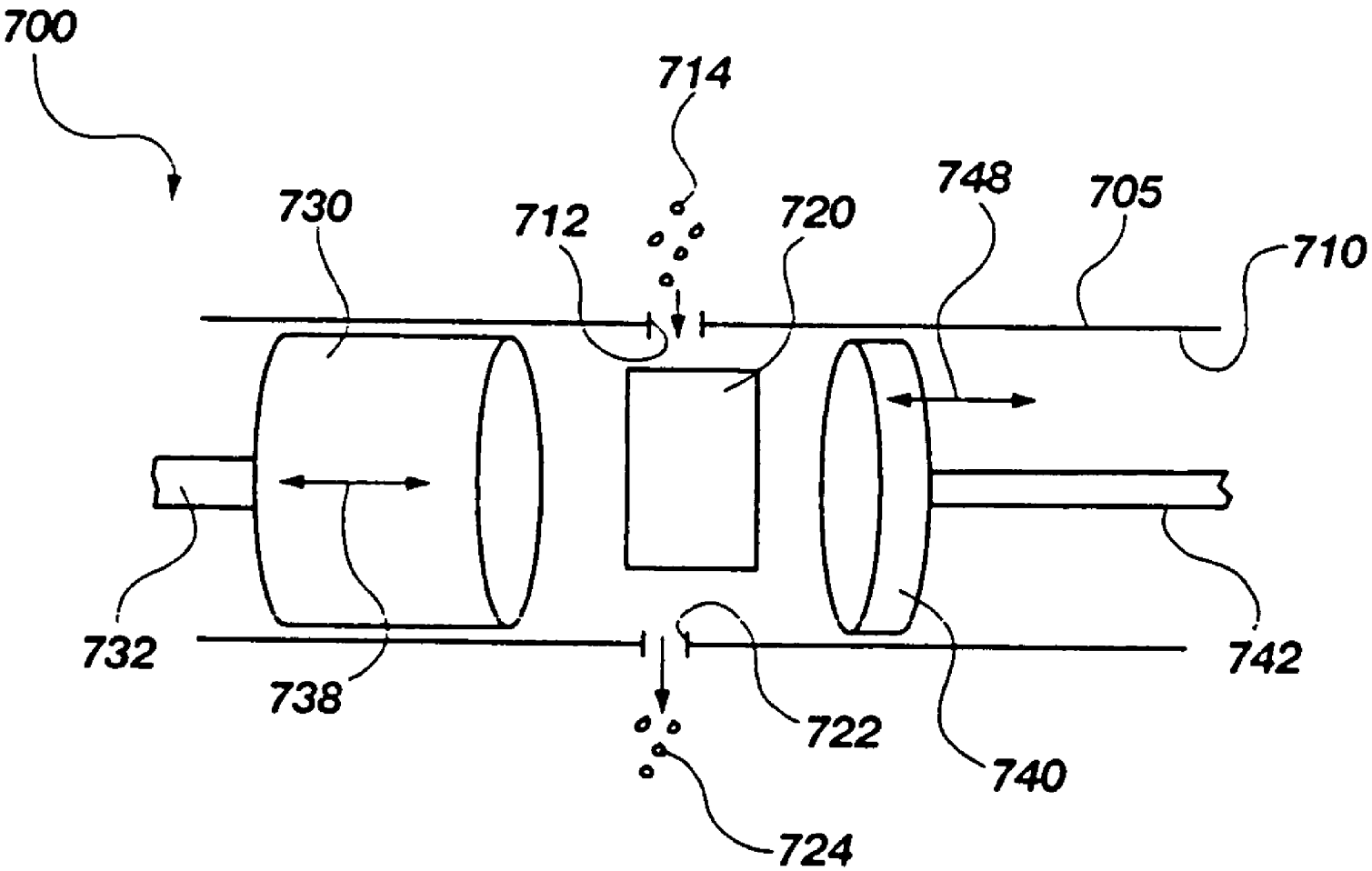
FIG. 8 illustrates a partial schematic side view of the rapid response energy extracting system, depicting a non-combustion system, according to a third embodiment of the present invention.

Referencing FIG. 8, the rapid response energy extracting system 700 may be provided in a non-combustion engine, according to a third embodiment of the present invention. The system 700 includes a chamber 710 with a primary piston 730 and a secondary piston 740. Instead of internal combustion provided by fuel and oxygen, a fluid 714, such as a monopropellant or hydrogen peroxide, may enter through an intake port 712 of the chamber 710. The fluid 714 may pass through or over a reaction member 720, such as a catalyst or heat-exchanger. Such a catalyst may include silver, silver alloy, and/or a silver/ceramic material. As the fluid 714 passes over the reaction member 720, a rapid non-combustive reaction results, which may include rapid decomposition of the fluid 714 and/or vaporization of the fluid 714. As in the IC engine, such rapid non-combustive reaction causes a rapid response from the secondary piston 740 for extracting a portion of energy from the rapid non-combustive reaction. In this system, the primary piston 740 may reciprocate and function similar to the primary piston in the IC engine or, alternatively, the primary piston 730 may simply act as a means for pumping fluid in and out of the chamber 710.

In each of the rapid response extracting systems 100, 200 and 700 as described in respective FIGS. 1, 3 and 8, pulsitile fluid flow can be provided from each of the systems respective secondary pistons 140, 240 and 740. However, in each of the systems the pulsitile fluid flow can change in modulation and frequency. Further, the load in which the energy of the pulsitile fluid flow is being directed can increase, decrease or remain constant. As such, a system for controlling and transferring the pulsitile fluid flow into usable energy that can handle a variable load is needed.

Figure 10:
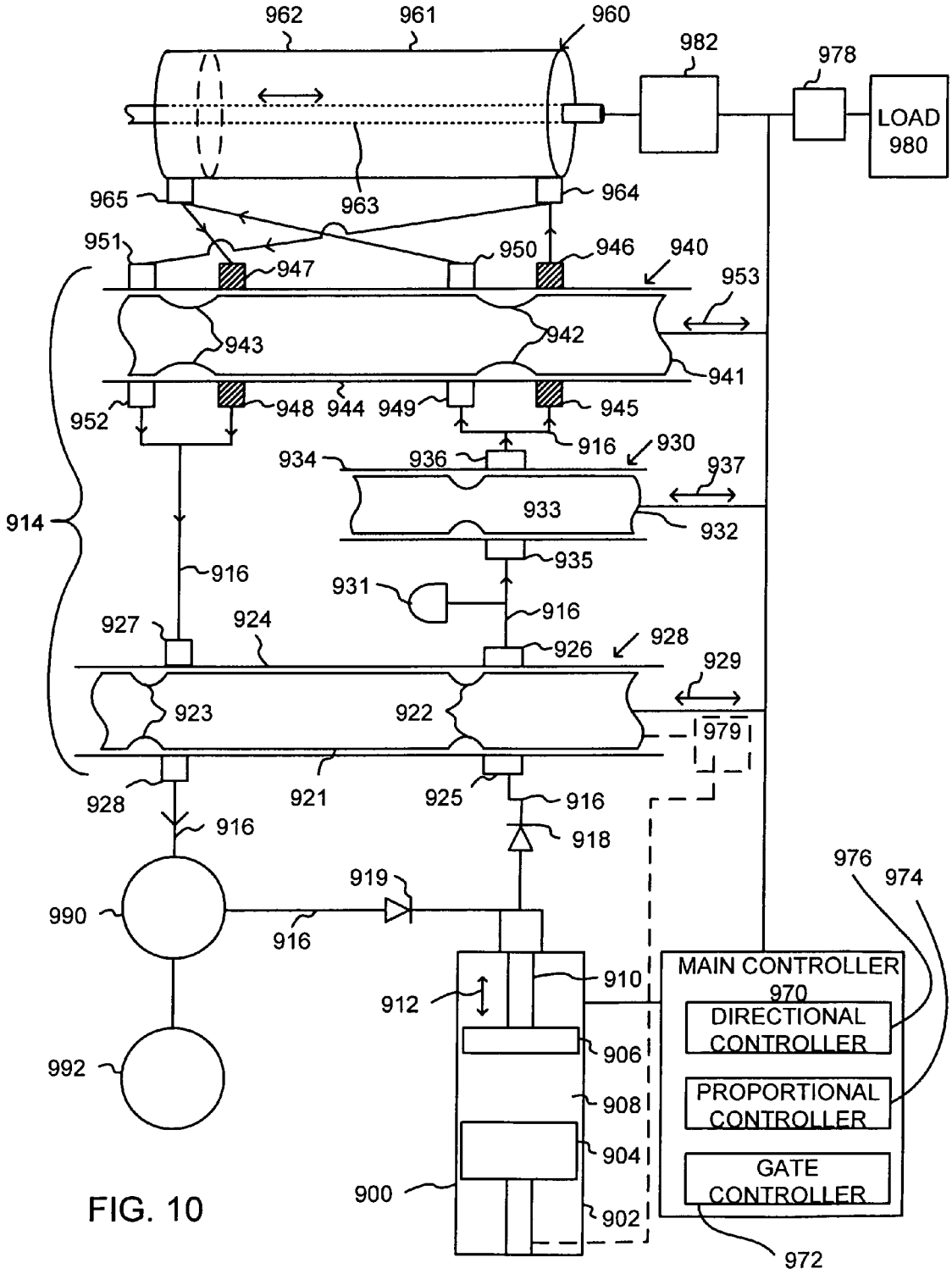
FIG. 10 illustrates a schematic view of a valve system for transferring energy from the rapid response energy extracting system to an actuator for driving a load, according to an embodiment of the present invention.

Referring now to FIG. 10, an embodiment of a valve system 914 operable to transfer energy from a rapid response energy extracting system 900, as previously set forth, to an actuator 960 which is configured to drive a load 980 is illustrated. The valve system 914 is configured to control pulsitile fluid flow from a secondary piston 906 to facilitate driving the load 980. Such a secondary piston 906 can be associated with any one of the rapid response energy extracting systems 100, 200 and 700 as described in respective FIGS. 1, 3 and 8.

The valve system 914 can include a gate valve 920, a proportional valve 930 and a directional valve 940 each acting in conjunction to control the pulsitile fluid flow from the secondary piston 906 to the actuator 960. Such a valve system 914 receives the pulsitile fluid flow and feeds the actuator 960 sequentially along a flow path 916 in the order of the gate valve 920, proportional valve 930 and then the directional valve 940. However, it is contemplated that such valve system 914 can be organized differently with variations thereof and include additional components and additional types of valves.

The valve system can include a main controller 970 operatively interconnected to the system 914, the load 980 and each of the gate valve 920, proportional valve 930 and the directional valve 940. Such main controller 970 can include various controller components configured to control the timing and movement of each of the gate valve 920, proportional valve 930 and the directional valve 940, to thereby, control and facilitate the pulsitile fluid flow through the valve system 914 to facilitate the transfer of energy from the secondary piston 906 to drive the load 980. Such various controller components can include a gate controller 972, a proportional controller 974 and a directional controller 976 each configured to control the fluid flow through each of the respective gate valve 920, proportional valve 930 and the directional valve 940.

As previously set forth, the secondary piston 906 reciprocates with linear movement as indicated by arrow 912 due to combustion in the combustion portion 908 of the chamber 902. Such reciprocation of the secondary piston 906 pumps a substantially non-compressible fluid, such as a hydraulic fluid or the like, to provide the pulsitile fluid flow. Such pulsitile fluid flow can be modulatable and vary with respect to frequency, which is regulatable by the controller 115 (FIG. 1), as previously set forth, to control the fuel input in the combustion portion 908 of the chamber 902.

The gate valve 920 is operatively coupled to the secondary piston 906 or the rapid response energy extracting system 900 and includes an opened and closed configuration operable to match the pulsitile fluid flow from the secondary piston 906. The pulsitile fluid flow is pumped along flow path 916 and through a check valve 918 before entering the gate valve 920. Such a gate valve 920 can be any known suitable gate valve as known to one of ordinary skill in the art. For example, the gate valve 920 can include a gate chamber 924 with a gate spool 921 disposed therein. The gate spool 921 can include a first opening or channel 922 and a second opening or channel 923 each configured to allow the pulsitile fluid to flow therethrough. The chamber 924 can include various inlets and outlets, such as, a first inlet and outlet 925 and 926 and a second inlet and outlet 927 and 928. The gate spool can be configured to reciprocate with bi-linear movement within the chamber, as indicated by arrow 929. The first inlet and outlet 925 and 926 and the second inlet and outlet 927 and 928 are positioned in the chamber to correspond with the respective first opening 922 and second opening 923. Such corresponding position provides that as the gate spool 921 reciprocates in the chamber 924, the gate valve can be in either an opened position to allow fluid to flow through the gate valve 920 or a closed position to prevent fluid from flowing through the gate valve 920.

For example, when the gate spool 921 is moved to the opened position, the first opening 922 is reciprocatedly positioned to correspond with the first inlet and outlet 925 and 926 and the second opening 923 is positioned to correspond with the second inlet and outlet 927 and 928. At the opened position, the fluid pulsatably flows from the secondary piston 906 and through the first opening 922 of the gate spool 921 toward the proportional valve 930 while fluid also flows simultaneously from the directional valve 940 through the second opening 923 of the gate spool to a first and/or second reservoir 990 and 992 and ultimately through a check valve 919 and back to the secondary piston 906. With this arrangement, the gate spool 921 in the gate valve 920 is configured to be moved in the opened position and the closed position to match the reciprocation of the secondary piston 906 to, thereby, allow the pulsitile fluid flow through the gate valve 920.

The matching of the gate spool 921 with the timing of the pulsitile fluid flow is employed with the main controller 970, and specifically, the gate controller 972. Such gate controller 972 is configured to be operatively coupled to the secondary piston 906 and the gate valve 920 so that the gate controller 972 can bi-linearly move the gate spool 921 to the opened and closed position to match the pulsitile fluid flow. In another embodiment, bi-linear movement of the gate spool 921 can be employed with a cam mechanism 979. The cam mechanism 979 can be operatively coupled to the gate spool 921 and the rod interconnected to the primary piston 904. In this manner, as the primary piston reciprocates from combustion, the movement of the rod of the primary piston 904 operatively coupled to the cam mechanism 979 causes the cam mechanism 979 to move the gate spool 921. Such cam mechanism 979 can be configured so that the gate spool 921 is bi-linearly moved to correspond with the timing of the pulsitile fluid flow from the secondary piston 906.

The proportional valve 930 is operatively coupled to the gate valve 920 and is configured to receive the pulsitile fluid flow from the gate valve 920. The proportional valve is operable to selectively restrict the pulsitile fluid flow from the gate valve to provide a selectively restricted fluid flow from the proportional valve. Such selective restriction of fluid flow means that fluid flow can be restricted proportionally as well as allow unrestricted fluid flow. Such a proportional valve 930 can be any suitable proportional valve configured to selectively restrict fluid flow and operable with a pulsitile fluid flow as known to one of ordinary skill in the art.

The proportional valve 930 can be configured to include a chamber 934 with a spool 932 disposed therein. The spool 932 can be configured to reciprocate bi-linearly within the chamber 934, as indicated by arrow 937. The spool can include an opening or channel 933 defined therein, which is configured to allow fluid to pass therethrough when the opening 933 is moved to a position corresponding with an inlet 935 and an outlet 936 defined in the chamber 934. The bi-linear movement of the spool 932 is operable via the main controller 970, and particularly, the proportional controller 974. Such main controller 970 is operatively coupled to the load 980 with a sensor 978 therebetween configured to sense the power necessitated to drive the load 980.

For example, in the case where the load 980 increases, decreases or is constant, the proportional controller 974 can control the position of the spool 932 to facilitate unrestricted fluid flow or restricted fluid flow to provide a selected fluid flow from the proportional valve to match that which is required to drive the load. Any excess fluid, due to restricted fluid flow, can be fed into an accumulator 931. Such accumulator 931 can be configured to receive excess fluid flow and provide such excess fluid flow to the proportional valve 930 as needed with respect to that which is required by the load.

The directional valve 940 is operatively coupled to the proportional valve 930 and is configured to receive the selective fluid flow from the proportional valve 930. Such a directional valve 940 is configured to selectively direct and provide a selectively directed fluid flow to the actuator 960. The directional valve 940 can be a four-way valve or any other suitable directional valve configured to drive an actuator 960 as known to one of ordinary skill in the art.

The directional valve 940 can include a directional chamber 944 and a directional spool 941 disposed therein. The spool 941 can include a first opening or channel 942 and a second opening or channel 943 defined therein each configured to allow fluid flow therethrough. The directional spool 941 is configured to reciprocate bi-linearly, as indicated by arrow 953, via the directional controller 976. The directional controller 976 is configured to positionally control the bi-linear movement of the directional spool 941 to selectively direct fluid flow from the directional valve. The first opening 942 and second opening 943 formed in the directional spool 941 are positioned in the spool 941 so that the spool 941 can reciprocate between and correspond with various inlets and outlets formed in the directional chamber 944 to manipulate and direct the fluid flow to and from the actuator 960.

For example, the directional spool 941 reciprocates so that the first opening 942 allows fluid flow toward the actuator 960 through a first inlet and outlet 945 and 946 while simultaneously the second opening 943 allows fluid flow from the actuator 960 in the opposite direction through a second inlet and outlet 947 and 948. Likewise, the directional spool 940 can linearly move so that the first opening 942 allows fluid flow toward the actuator 960 through a third inlet and outlet 949 and 950 while simultaneously the second opening 943 allows fluid flow from the actuator 960 in the opposite direction through a fourth inlet and outlet 951 and 952. As such, the first and second openings 942 and 943 in the directional valve 940 are configured to be positioned with the lets and outlets to provide a fully opened channel for fluid to flow through without restriction. With this arrangement, the fluid flow through the first and second openings 942 and 943 and the above-described corresponding inlets and outlets in the directional valve 940 provides a selectively directed fluid flow to the actuator 960.

The actuator 960 is operatively coupled to the directional valve and is configured to receive the selectively directed fluid flow from the directional valve 940, as previously set forth, to drive the load 980 coupled to the actuator 960. Such an actuator 960 can be any suitable type of actuator 960 configured to actuate with fluid as known to one of ordinary skill in the art. The actuator 960 can include a chamber 961 with a piston 962 fixed to a rod 963 disposed therein. The piston 962 and rod 963 can bi-linearly reciprocate within the chamber 961, as indicated by arrow 966. As the piston 962 and rod 963 are reciprocated back and forth, fluid flow is directed in and out of the chamber 961 through a first and second flow valve 964 and 965. For example, when fluid enters through the first flow valve 964 from the first outlet 946 of the directional valve 940, the fluid moves the piston 962 to the left which also moves fluid out of the second flow valve 965 toward the second inlet 947 of the directional valve 940. The directional spool 941 then linearly moves to allow fluid to be directed from the third outlet 950 of the directional valve 940 to flow through the second flow valve 965 of the actuator 960, which fluid facilitates movement of the piston 962 to the right and moves the fluid out of the first flow valve 964 toward the fourth inlet 951 of the directional valve 940.

The rod 963 of the actuator 960 is operatively coupled to the load 980 and can be coupled to an energy transfer member 982. The energy transfer member 982 can be configured to provide power to drive the load 980. Such power is transferred from the reciprocating movement of the rod 963, facilitated by the directed fluid flow through the actuator 960. The energy transfer member 982 can be configured to transfer the movement of the rod 963 into any one of mechanical energy, electrical energy, pneumatic energy and hydraulic energy, which depends on the configuration of such energy transfer member 982. Such energy transfer member 982 can be implemented and configured to operate with the actuator 960 by one of ordinary skill in the art.

With the above described arrangement, the present invention provides a method for transferring energy from a rapid response energy extracting system having the secondary piston 906 associated with an internal combustion engine 900 for driving a load 980. In this method, the internal combustion engine 900 is operated so that the secondary piston 906 pulsates with respect to combustion in the internal combustion engine 900 to pump a fluid from the secondary piston 906, thereby, obtaining a pulsitile fluid flow. The pulsitile fluid flow is fed to the gate valve 920, which is operatively coupled to the secondary piston 906 and is configured to open and close to match the pulsitile fluid flow. The gate valve 920 feeds the pulsitile fluid flow to the proportional valve 930, which is operatively coupled to the gate valve 920 and is configured to selectively restrict the pulsitile fluid flow, thereby, obtaining a selectively restricted fluid flow. The proportional valve 930 feeds the selectively restricted fluid flow to the directional valve 940, operatively coupled to the proportional valve 930, which selectively directs fluid flow to the actuator 960. As such, the actuator 960 is reciprocatedly driven by the selectively directed fluid flow from the directional valve 940. As fluid is selectively directed into the actuator 960, fluid is also driven out of the actuator 960 and back to the directional valve 940, which is then fed back to the gate valve 920 and ultimately back to the secondary piston 906. The actuator 960 is operatively coupled to the load 980 and configured to drive the load 980. Such actuator 960 can be coupled to an energy transferring member 982 to transfer the reciprocating movement of the actuator 980 to power or energy for driving the load 980. Such energy transferring member 982, as previously set forth, can be any one of mechanical energy, electrical energy, pneumatic energy and hydraulic energy.

While the preceding discussion focused on the characteristics of four stroke internal combustion engines as primary power sources, the present invention is not restricted to use with an internal combustion engine. The present invention can be utilized with any primary power source that delivers variable pulsating pressure. For example, two-stroke internal combustion engines, diesel engines, Stirling engines, external combustion engines and heat engines can all be used as primary power sources for the rapid response power conversion device. The above described present invention may be used to provide energetic autonomy to power sources used in robotics. Robots could be powered by self-contained fuel consumption devices which are not tethered to any primary power source. Because the present invention allows for direct conversion of fuel into rapid response energy, any intermediate storage device such as a large hydraulic accumulator or electric battery would no longer be necessary, eliminating large weight additions to the robot without sacrificing the speed with which the robot could access power.

For example, the present invention could be used to provide energetic autonomy to power sources used in robotics. Robots could be powered by self-contained fuel consumption devices which are not tethered to any primary power source. Because the present invention allows for direct conversion of fuel into rapid response energy, any intermediate storage device such as a hydraulic accumulator or electric battery would no longer be necessary, eliminating large weight additions to the robot without sacrificing the speed with which the robot could access power.

Figure 9:
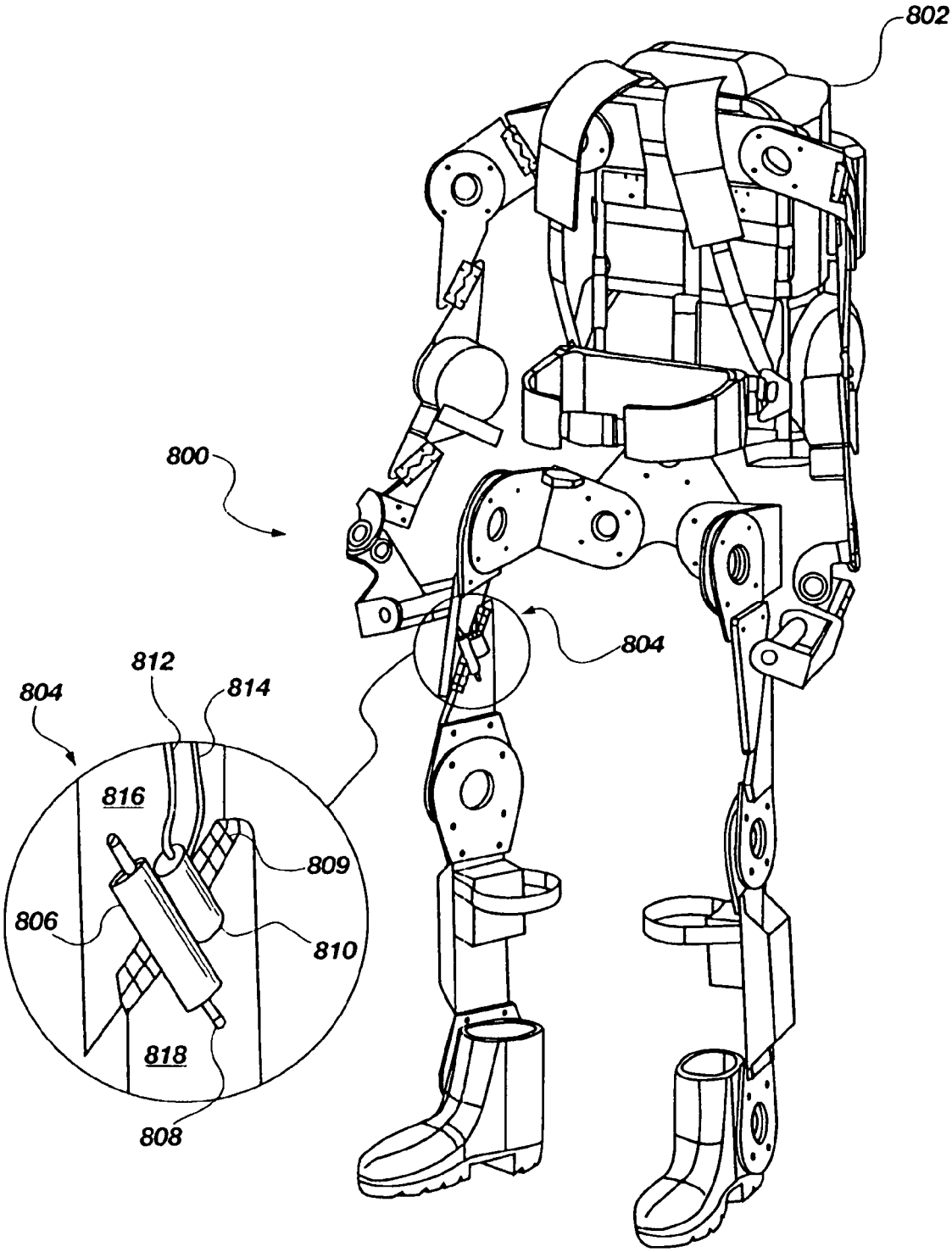
FIG. 9 illustrates an elevation view of a representative use of the present invention, as used in a wearable exoskeleton frame.

In addition to providing a lightweight, energetically autonomous rapid response power source for use in robotics, the present invention could be used in much the same way to assist human movement. Shown generally at 800 in FIG. 9 is a wearable exoskeletal frame for use by a human. A central control unit 802 can serve as a fuel storage device, power generation center and/or a signal generation/processing center. Shown at 804, attached at 808 to the joints of the exoskeleton 809 is an actuator 806. The cylinder (not shown) within the actuator can be extended or retracted to adjust the relative position of the upper and lower leg segments, 816 and 818, respectively, of the exoskeletal frame. The actuator 806 can be driven by a rapid response power conversion device 810. The rapid response power conversion device can be a small internal combustion engine supplied by fuel from fuel line 812 and controlled by an input/output signal line 814. The system can be configured such that an actuator and a power conversion device are located at each joint of the exoskeletal frame and are controlled by signals from the master control unit 802. Alternately, the system could be configured such that one or more master power conversion devices are located in the central control unit 802 for selectively supplying power to actuators located at each joint of the exoskeleton. Sensors (not shown) could be attached to various points of the exoskeleton to monitor movement and provide feedback. Also, safety devices such as power interrupts (not shown) can be included to protect the safety of the personnel wearing the exoskeletal frame.

The wearable exoskeletal frame could be used in many applications. In one embodiment, the frame could be configured to assist military personnel in difficult or dangerous tasks. The energetically autonomous rapid response power conversion device can allow conventional primary power sources to be used to enhance the strength, stamina and speed of personnel without requiring that the personnel be tethered to a primary power source. The wearable frame could reduce the number of personnel required in dangerous or hazardous tasks and reduce the physical stress experienced by personnel when executing such tasks. The wearable frame could also be configured for application-specific tasks which might involve exposure to radiation, gas, chemical or biological agents.

The wearable frame could also be used to aid physically impaired individuals in executing otherwise impossible tasks such as sitting, standing or walking. The rapid response power conversion device could serve as a power amplifier, amplifying small motions and forces into controlled, large motions and forces. By strategically placing sensors and control devices in various locations on the frame, individuals who are only capable of applying very small amounts of force could control the motion of the frame. Because the rapid response power conversion device is energetically autonomous, physically impaired individuals could be given freedom of movement without being tethered to a power source. The rapid response power conversion device would also be capable of producing the small, discrete movements necessary to imitate human movement. Safety devices such as power interrupts could be built into the system to prevent unintentional movement of the frame and any damage to the individual wearing the frame.

In addition to the previous applications, the present invention can be used in any number of applications that require rapid response power without tethering the application to a primary power source. Examples can include power driven wheelchairs, golf carts, automobiles, skateboards, scooters, ultra-light aircraft, and other motorized vehicles, and generally any application which leverages mechanical energy and which would benefit by energetic autonomy.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. Thus, while the present invention has been shown in the drawings and fully described above with particularity and detail in connection with what is presently deemed to be the most practical and preferred embodiment(s) of the invention, it will be apparent to those of ordinary skill in the art that numerous modifications, including, but not limited to, variations in size, materials, shape, form, function and manner of operation, assembly and use may be made, without departing from the principles and concepts of the invention as set forth above.

What is claimed is:

1. A valve/actuator system configured to control pulsitile fluid flow from a rapid response component associated with an internal combustion engine, the valve/actuator system comprising:

a gate valve, configured to be operatively coupled to the rapid response component, having an opened and closed configuration to match the pulsitile fluid flow from the rapid response component;

a proportional valve, operatively coupled to said gate valve, operable to selectively restrict said pulsitile fluid flow from said gate valve to provide a selectively restricted fluid flow from said proportional valve;

a directional valve, operatively coupled to said proportional valve, operable to receive said selectively restricted fluid flow from said proportional valve and selectively direct a selectively directed fluid flow; and an actuator, operatively coupled to said directional valve, operable to receive the selectively directed fluid flow from said directional valve to drive a load coupled to said actuator.

2. The valve/actuator system of claim 1, wherein said gate valve, said proportional valve and said directional valve act in conjunction to manipulate the pulsitile fluid flow received from the rapid response component to drive said load coupled to said actuator.

3. The valve/actuator system of claim 1, wherein said gate valve, said proportional valve and said directional valve act in conjunction as a synchronized pulsitile valve system operable to handle the pulsitile flow from the rapid response component.

4. The valve/actuator system of claim 3, wherein said synchronized pulsitile valve system comprises a synchronized modulatable, pulsitile valve system operable to handle modulatable, pulsating fluid flow from the rapid response component.

5. The valve/actuator system of claim 1, wherein said gate valve is interconnected and synchronized with the operation of at least one of the rapid response component and the internal combustion engine so that said gate valve opens and closes to match said pulsitile fluid flow.

6. The valve/actuator system of claim 1, wherein said gate valve is operatively coupled to said actuator to receive exhaust fluid flow from said actuator.

7. The valve/actuator system of claim 1, further comprising an accumulator, coupled to said proportional valve, operable to accumulate excess fluid from said pulsitile fluid flow restricted by said proportional valve.

8. The valve/actuator system of claim 1, further comprising a gate controller interconnected between said gate valve and the internal combustion engine, said gate controller operable to open and close said gate valve to correspond with said pulsitile fluid flow.

9. The valve/actuator system of claim 8, wherein said gate controller includes a cam member interconnected to the internal combustion engine.

10. The valve/actuator system of claim 8, wherein said gate controller includes an electrical switch timed to open and close said gate valve to correspond with the pulsitile fluid flow.

11. The valve/actuator system of claim 1, further comprising a proportional controller interconnected to said proportional valve, said actuator and the internal combustion engine to selectively control the pulsitile fluid flow with respect to said load coupled to said actuator.

12. The valve/actuator system of claim 1, further comprising a directional controller, interconnected to said directional valve, operable to control said selectively directed fluid flow from said directional valve to direct said actuator and to drive said load coupled to said actuator.

13. The valve/actuator system of claim 12, wherein said directional controller includes a digital directional controller.

14. The valve/actuator system of claim 1, wherein said directional valve includes a four-way valve operable to drive said actuator and said load.

15. The valve/actuator system of claim 1, wherein said actuator includes a piston slidable in a cylinder, said piston operable to reciprocate and drive said load.

16. A system configured to drive a load by transferring energy from an internal combustion engine having a chamber and a piston with a combustion portion in the chamber, the chamber having at least one fuel inlet to supply fuel thereto and an exhaust outlet, the fuel configured to at least partially facilitate combustion in the combustion portion of the chamber to provide energy therein and to act upon the piston, said system comprising:

a rapid response component, configured to be operatively coupled to the combustion portion of the chamber, said rapid response component configured to draw a portion of said energy from said combustion in said chamber and transfer said portion of said energy as a fluid including pulsitile fluid flow;

a valve system, operatively coupled to said rapid response component, operable to receive said pulsitile fluid flow from said rapid response component and controllably direct said pulsitile fluid flow from said rapid response component; and an actuator, operatively coupled to said valve system and configured to be operatively coupled to the load, said actuator operable to receive said fluid from said valve system to drive the load operatively coupled thereto.

17. The system of claim 16, wherein said rapid response component is configured to draw said portion of said energy from said chamber during a time period from a proximate instant of said combustion and prior to the piston of the internal combustion engine reciprocating to a position at a median between a top dead center position and a bottom dead center position.

18. The system of claim 16, wherein said rapid response component is operable to pulsate to provide said pulsitile fluid flow at selected cycles of one or more cycles so that said selected cycles are non-continuous compared to that of the piston in the internal combustion engine configured to substantially continuously reciprocate in the chamber.

19. The system of claim 18, wherein said selected cycles of said pulsitile fluid flow are modulatable with respect to each other.

20. The system of claim 16, wherein said valve system comprises at least a gate valve, a proportional valve and a directional valve.

21. The system of claim 20, wherein said gate valve, said proportional valve and said directional valve act in conjunction to manipulate said pulsitile fluid flow received from said rapid response component to drive the load coupled to said actuator.

22. The system of claim 20, wherein said gate valve is operatively coupled to said rapid response component and includes an open and closed configuration to match said pulsitile fluid flow from said rapid response component.

23. The system of claim 22, wherein said proportional valve is operatively coupled to said gate valve and is operable to selectively restrict said pulsitile fluid flow from said gate valve to provide a selectively restricted fluid flow.

24. The system of claim 23, wherein said directional valve is operatively coupled to said proportional valve and is operable to receive said selectively restricted fluid flow from said proportional valve and selectively direct a selectively directed fluid flow.

25. The system of claim 24, wherein said actuator is operatively coupled to said directional valve and is operable to receive said selectively directed fluid flow from said directional valve to drive said load coupled to said actuator.

26. The system of claim 23, further comprising an accumulator, operatively coupled to said proportional valve, operable to accumulate excess fluid from said pulsitile fluid flow restricted by said proportional valve.

27. The valve system of claim 20, wherein said gate valve, said proportional valve and said directional valve act in conjunction as a synchronized pulsitile valve system operable to handle said pulsitile fluid flow from said rapid response component.

28. The valve system of claim 27, wherein said synchronized pulsitile valve system comprises a synchronized modulatable, pulsitile valve system operable to handle modulatable, pulsating fluid flow from said rapid response component.

29. A method of transferring energy from a rapid response component associated with an internal combustion engine to drive a load, the method comprising:

operating the internal combustion engine so that the rapid response component pulsates with respect to combustion in the internal combustion engine to pump a fluid from the rapid response component;

obtaining a pulsitile fluid flow from the rapid response component;

opening and closing a gate valve operatively coupled to the rapid response component to match said pulsitile fluid flow;

selectively restricting said pulsitile fluid flow through a proportional valve operatively coupled to said gate valve; and selectively directing said fluid to at least one actuator operatively coupled to the load with a directional valve operatively coupled to the proportional valve.

30. The method of claim 29, wherein said obtaining said pulsitile fluid flow comprises pulsating said pulsitile fluid flow at selective cycles of one or more cycles so that said selected cycles are modulatable with respect to each other.

31. The method of claim 30, wherein said pulsating comprises modulating said selective cycles by changing a timing of combustion in the internal combustion engine.

32. The method of claim 30, wherein said pulsating comprises modulating said selective cycles by changing an amount of fuel for combustion in the internal combustion engine.

* * * * *